US006257580B1

(12) United States Patent
Brown

(10) Patent No.: US 6,257,580 B1
(45) Date of Patent: Jul. 10, 2001

(54) CASINO TABLE GAME INCLUDING CARDS AND DICE

(76) Inventor: Ben Brown, 109 Mauve St., Henderson, NV (US) 89012

( * ) Notice: Subject to any disclaimer, the term of this patent is extended or adjusted under 35 U.S.C. 154(b) by 0 days.

(21) Appl. No.: 09/663,376

(22) Filed: Sep. 15, 2000

(51) Int. Cl.[7] ..... A63F 1/00
(52) U.S. Cl. ..... 273/274; 273/146
(58) Field of Search ..... 473/274, 292, 473/146

(56) References Cited

U.S. PATENT DOCUMENTS

| | | | | |
|---|---|---|---|---|
| 3,919,919 | | 10/1975 | Carpenter . | |
| 5,265,881 | | 11/1993 | Doherty | 273/274 |
| 5,397,128 | | 3/1995 | Hesse | 273/292 |
| 5,407,208 | * | 4/1995 | Keller et al. . | |
| 5,676,375 | | 10/1997 | Pirouzkha | 273/274 |
| 5,746,432 | * | 5/1998 | Feola . | |
| 5,839,728 | | 11/1998 | Kao | 273/274 |
| 5,842,698 | * | 12/1998 | Brown . | |
| 5,857,676 | | 1/1999 | Whitson | 273/292 |
| 5,997,000 | | 12/1999 | Nakano | 273/274 |
| 6,062,563 | | 5/2000 | de Keller | 273/274 |
| 6,062,564 | | 5/2000 | Terminel | 273/292 |

* cited by examiner

*Primary Examiner*—William M. Pierce
(74) *Attorney, Agent, or Firm*—Tom Hamill, Jr.

(57) ABSTRACT

A wagering game for casinos and the like is disclosed. The wagering game includes a game table, a plurality of decks of cards, and a pair of dice. The object of the game is to have the highest total score by combining the score of a card summed with the score rolled on a die. All face cards count as 10 with the exception of the Ace which counts as 1. The numbered cards have a numerical designation which is identical to the number which appears thereon. Two die are provided, the die may preferably be of different colors. The general course of play is as follows. The players make a wager. A side bet that a 16 will be dealt may also be made. The dealer deals a single card to the players as well as to himself. The dealer then rolls the two dice. A first color die represents the dealer and the second color die represents the players. The cards of the players are summed with the player's die score and the card of the dealer is summed with the dealer's die score. The highest possible score is 16. The player wins if the player's score is greater than the dealer's score and is paid even money. The dealer wins if the dealer's score is equal to or greater than the player's score. If a player is dealt a 16 and has placed a side bet, the player is paid at 16:1 even if the dealer has a 16. Other methods of wagering and of play are also disclosed herein.

9 Claims, 4 Drawing Sheets

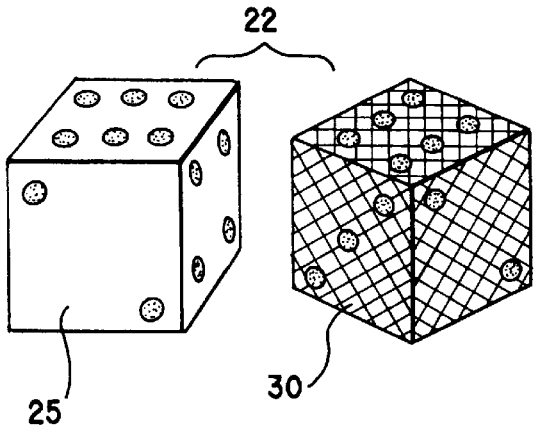
FIG.3
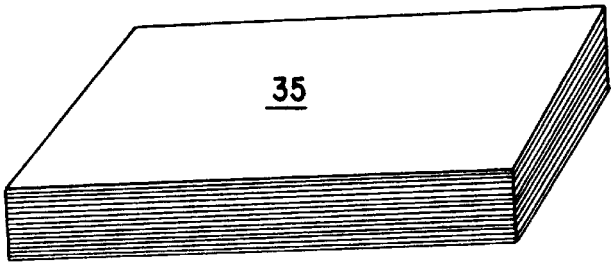
FIG.4
FIG.5
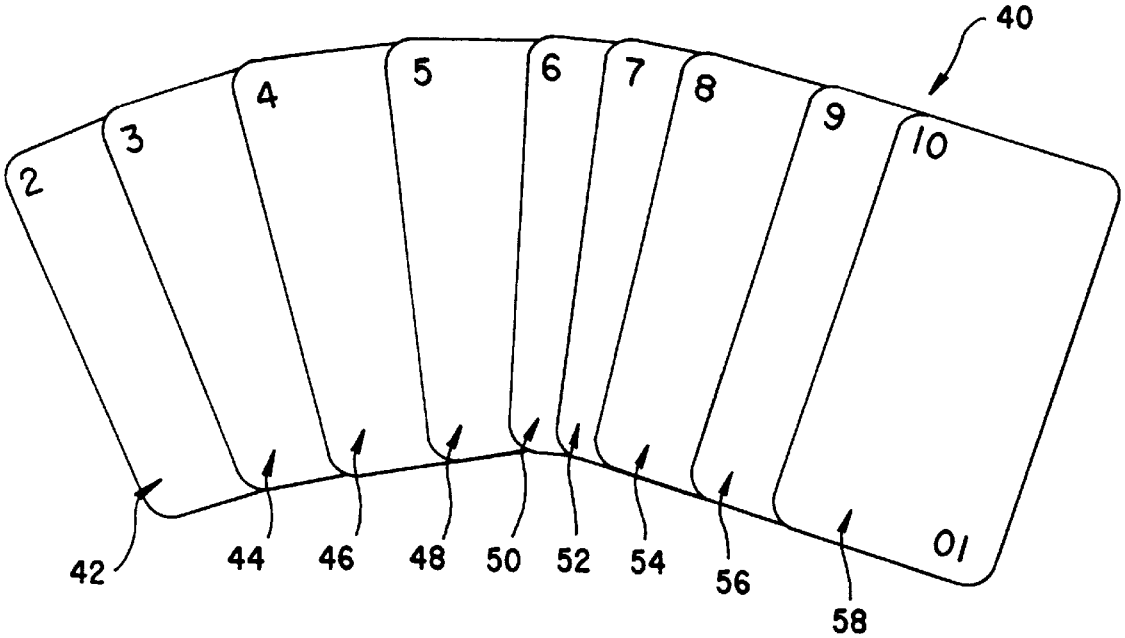

CASINO TABLE GAME INCLUDING CARDS AND DICE

BACKGROUND OF THE INVENTION

1. Field of the Invention

The present invention relates generally to wagering games, and more particularly, to a wagering game where the sum of the number which is rolled on a die is added to a the number of a randomly selected card.

2. Description of the Prior Art

Various casino style games which employ the use of cards are known in the art. Various casino style games which employ the use of dice are known in the art. The provision of a wagering game which combines the use of a dice and of cards has not been contemplated. Further, the provision of a wagering game which uses dice and cards in the manner of the rules of play of the instant invention has not been contemplated. Additionally, wagering methods, coupled with the rules of play of the instant invention has not been contemplated.

SUMMARY OF THE INVENTION

A wagering game for casinos and other wagering institutions is provided. The wagering game includes a game table, a plurality of decks of cards, and several dice. The object of the game is to have the highest total score by combining the score of a card summed with the score rolled on a die. All face cards count as 10 with the exception of the Ace which counts as 1. The numbered cards have a numerical designation which is identical to the number which appears thereon. Two die are provided, the die may preferably be of different colors. The general course of play is as follows. The players make a wager. The dealer deals a single card to the players as well as to himself. The dealer then rolls the two dice. A first color die represents the dealer and the second color die represents the players. The cards of the players are summed with the players die score and the card of the dealer is summed with the dealer die score. The highest possible score is 16. The player wins if the player's score is greater than the dealer's score and is paid even money. The dealer wins if the dealer's score is equal to or greater than the player's score. If a player is dealt a 16 and has placed a side bet, the player is paid at 16:1 even if the dealer has a 16. Other methods of wagering and of play are also disclosed below.

The table employed is a conventional "blackjack" style table. The top of the table may be felt or the like. It has a top surface with a plurality of inscribed player stations. Each player station may include indicia indicating where the card would be placed in front of the players. A first wagering circle would be provided in front of each player, the first wagering circle would be for the primary wager or bet to beat the dealer. Additionally, a second wagering circle with the number 16 inscribed therein, (or some other appropriate indicia or designation) would be provided in front of each of the players. This would represent the area where a side wager (side-bet) would be placed that the player would hit 16 (10 card with a roll of 6 on the player's die), with a 16-1 payoff. Indicia may be disposed on the table describing the game, such as "Sweet 16" or "16 to 1" or other appropriate sayings, slogans, advertisements, logos, trademarks, etc.

The top surface of the table would also include a dealer station. The dealer station may include an area where the dealers card would be placed. The dealer deals the cards to the players and himself. The dealer then shakes the dice in the shaker and throws the dice on the table. One die would represent the number which would be added to the dealer's card and the other die would represent the number which would be added to the player's card. The dice would be coded to identify them as the player's die and the dealer's die. The easiest way to code the dice would be to make them of different colors, although any of a variety of methods may be employed. These methods may include visual indicia which differentiates the two die, such as vertical stripes, horizontal stripes or the like.

The game starts with the player making a wager in the first circle. An additional or side bet may be placed in the circle with the "16" indicia therein. The wager in either circle may be to any amount up to the maximum permitted by the table. In an additional embodiment, the side bet may be equal to or less than the original wager, but cannot exceed the original wager. Different variants of the side bet may be dictated by casino rules.

The dealer gives each player one card face up and the dealer one card face down in the appropriate location which are inscribed on the tabletop. If the player does not have a 10 or a face card, the dealer collects any bets made in the "16" circle as this side bet is lost by the player.

At this point, 3 playing (wagering) options are available to the player. First, the player may surrender ½ of their original wager and the hand is over. In this first case, the player pays a fee of ½ of the original wager, this fee is immediately collected and placed in the dealer's chip rack. Second, the player may keep the card they have and play to the end of the hand. Third, the player can pay the house ½ of their original wager and receive a new card from the dealer, forfeiting their original card and then play until the end of the hand. The fee is not added to the original bet. The original bet is not sacrificed, but the fee is taken from the player's chips and placed in the dealer's chip rack. This fee is paid out of the player's chips which are not in play. This option may only be elected once per round.

Once the players have made their decisions, the dealer turns his card face up.

The dealer would then take the dice cup with the two dice inside. For this example, the player's die will be red and the house die will be blue. The dealer shakes the dice in an appropriate manner and throws them on the table. The dealer will add the numerical designation of his card with the value shown on the blue house die and the players will add the numerical designation of their cards with the value shown on the red player's die. The higher of the two totals between the player and the dealer is the winner. More than one player may win. More than one player can lose.

The house wins all ties in the original bet circle. If a player has a final total of 16 and a wager in the "16" circle and a wager in the original bet circle, and the dealer also has a final total of 16, the player would lose his original wager, but be paid for the "16" circle wager.

If the player has the higher total they are paid out at even money for their original wager. If the player total is 16 and they had a wager in the "16" circle they are paid out at the rate of 16 to 1.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will form the subject matter of the claims appended hereto.

In this respect, before explaining the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which this disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a wagering game which combines the sum of the value present on the face of a ordinary card drawn from a deck or multiple decks of cards with a number rolled on a six sided dice.

It is an object of the present invention to provide a wagering game with a 16:1 payoff when the player is dealt a 16 and a side bet is placed.

It is an object of the present invention is to provide a wagering game with an even money payoff when the player has a greater score than the dealer.

It is an object of the present invention to provide a wagering game which permits the player to call, ie: keep their card and their wager as it is.

It is another object of the present invention to provide a wagering game which permits the player to surrender, ie: to forfeit half their bet and sit out the remainder of the hand.

It is another object of the present invention to provide a wagering game which permits the player to replace their card, ie: for a fee of ½ the original wager the player can receive a new card, pursuant to the rules of the game.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawings wherein:

FIG. 3 is a pair of dice which are distinguishable from each other employed in the wagering game.

FIG. 4 is a deck of cards which may represent multiple decks of card which are employed in the wagering game.

FIG. 5 is a view of the number cards, each of the number cards given the numeric value shown thereon.

DESCRIPTION OF THE PREFERRED EMBODIMENT

With reference now to the drawings, a wagering game which adds the number drawn on a card to a number rolled on a dice will be described.

Figure 1:
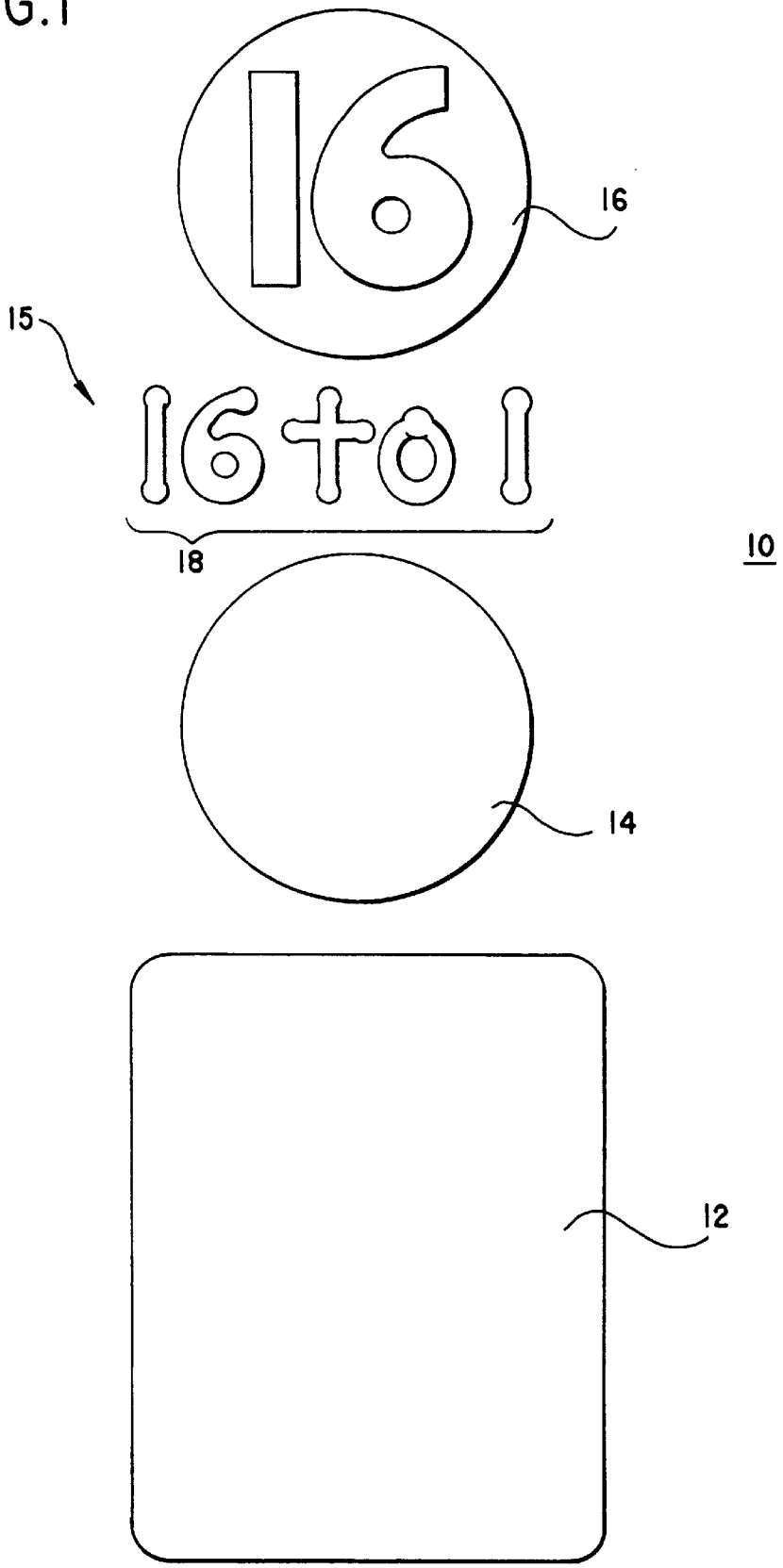
FIG. 1 is a close-up view of the player's station on the betting table of the wagering game.

FIG. 1 shows a player's station 15 on the betting table 10. A rectangular outline 12 is provided in which the dealer would place the player's card. A first wagering circle 14 is provided for the player to place his wager. A second wagering circle 16 is provided for the player to place a side bet or a second wager that the player will hit 16. Inside the second wagering circle 16 the number "16" is provided in order to differentiate the second wagering circle 16 from the first wagering circle 14. Intermediate the first wagering circle 14 and the second wagering circle 16 is indicia 18. Similar indicia 18 may be located at any position on the betting table 15. The precise configuration of the card outline 12, first wagering circle 14 and second wagering circle 16 are arbitrary, however, generally the wagering circles are located proximal the dealer.

Figure 2:
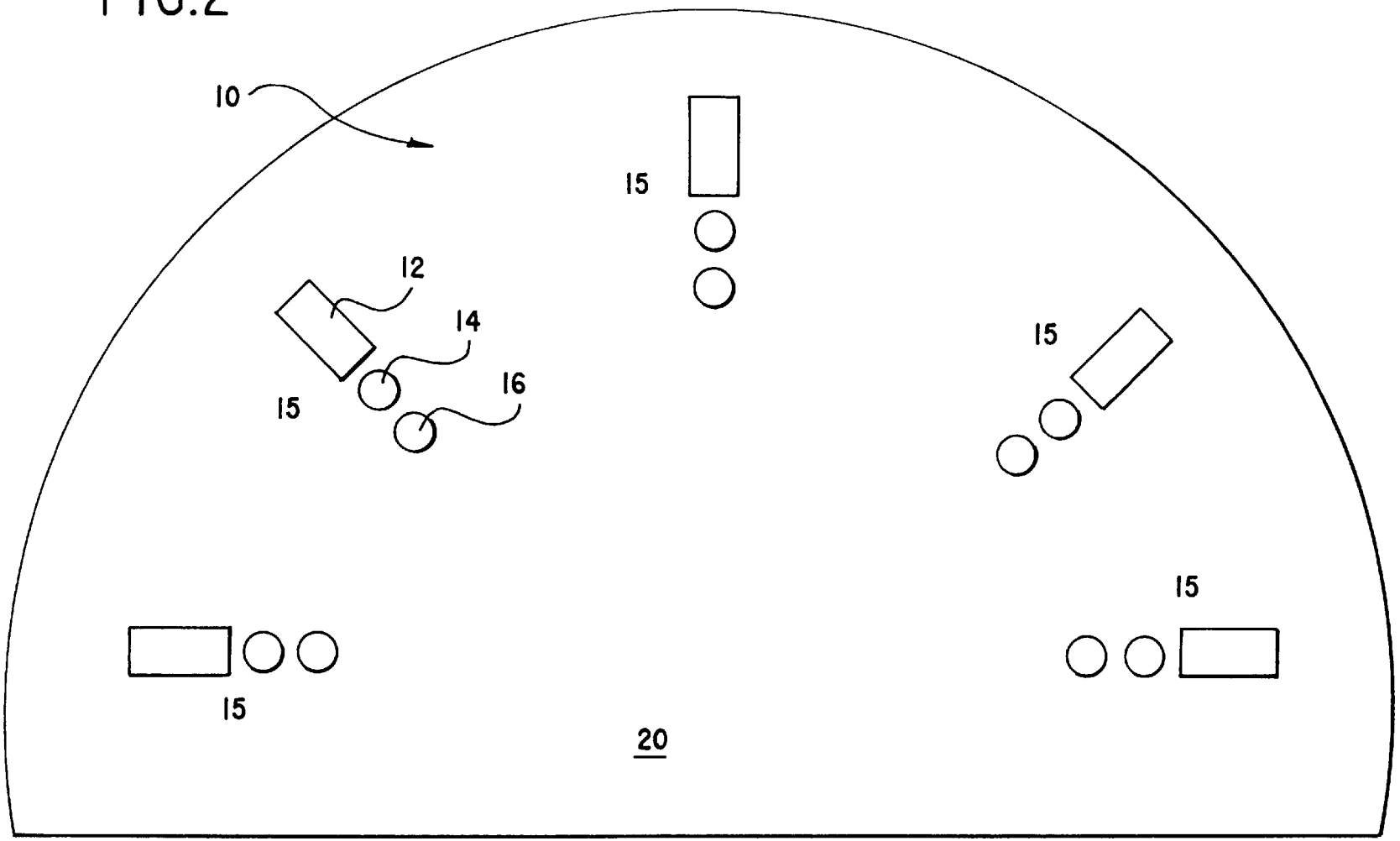
FIG. 2 is a top view of the betting table of the wagering game.

FIG. 2 shows a betting table 10 with multiple player's stations 15. The dealer's area 20 will be where the dealer's card will be placed as well as where the cards will be held prior to play. The dealer's area 20 will also be where the dice 22 and the dice shaker will be placed.

FIG. 3 shows a pair of dice 22. The pair of dice 22 comprises a first die 25 and a second die 30. The first die 25 and the second die 30 are distinguishable, ie, they are of different colors, have different patterns, or have some other distinguishing features so that they are easily discernable from each other. The first die 25 may be chosen to be the player's die and the second die 30 may be chosen to be the dealer's die.

FIG. 4 shows a deck of cards 35. The wagering game of the instant invention may be played with at least one deck of cards 35. It is to be understood that multiple decks of cards may be employed in any one game. In one embodiment of the game 4 decks of cards will be employed.

FIG. 5 shows the numbered cards 40. They have a numerical designation equal to the value present on their face. Therefore the two card 42 has a value of 2. The three card 44 has a value of 3. The four card 46 has a value of 4. The five card 48 has a value of 5. The six card 50 has a value of 6. The seven card 52 has a value of 7. The eight card 54 has a value of 8. The nine card 56 has a value of 9. The ten card 58 has a value of 10. These numbered cards 40 may represent any of the 4 suits, diamonds, hearts, clubs and spades.

Figure 6:
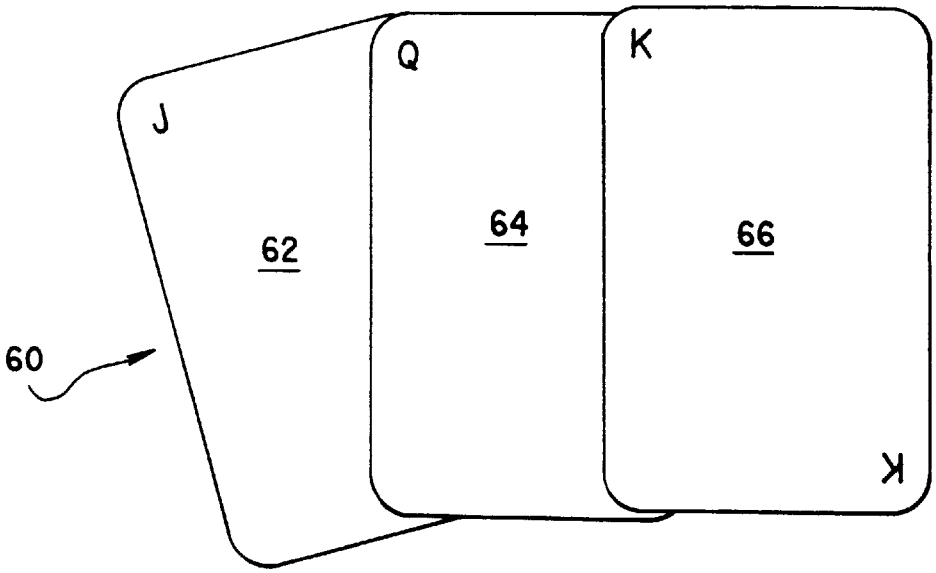
FIG. 6 is a view of the face cards, each of the face cards given a numeric value of 10.

FIG. 6 shows the face cards 60. The Jack 62 has a value of 10. The Queen 64 has a value of 10. The King 66 has a value of 10. These face card 60 may represent any of the four suits, diamonds, hearts, clubs, and spades.

Figure 7:
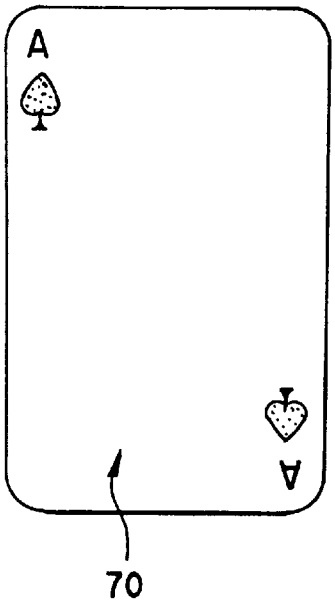
FIG. 7 is a view of an ace card, the ace card given a numeric value of 1 (one).

FIG. 7 shows the Ace 70. The Ace 70 has a value of one (1). The Ace 70 may represent any of the four suits, diamonds, hearts, clubs, and spades.

Figure 8:
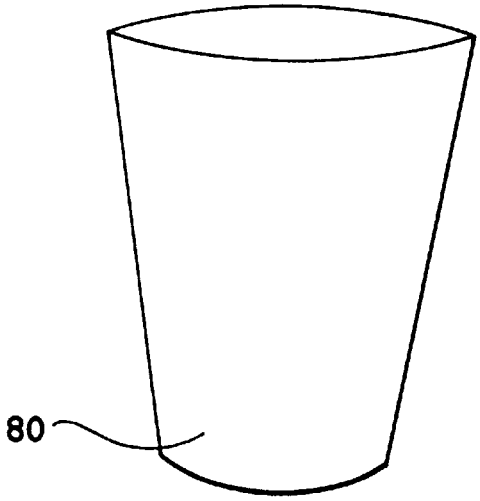
FIG. 8 is a view of a dice shaker.

FIG. 8 shows a dice shaker 80. The dice 22 are to be placed in the dice shaker 80 and thrown on the betting table 10 proximal the dealer's area 20.

METHOD OF PLAY

The game starts with the player making a wager in the first circle 14. An additional or side bet may be placed in the second circle 16 with the "16" indicia therein. The wager in either circle may be to any amount up to the maximum permitted by the table. In an additional embodiment, the side bet may be equal to or less than the original wager, but cannot exceed the original wager. Different variants of the side bet may be dictated by casino rules.

The dealer gives each player one card face up and the dealer one card face down in the appropriate location 12 which are inscribed on the tabletop. If the player does not have a 10 or a face card, the dealer collects any bets made in the "16" circle as this side bet is lost by the player.

At this point, 3 playing (wagering) options are available to the player. First, the player may surrender ½ of their original wager and the hand is over. In this first case, the player pays a fee of ½ of the original wager, this fee is immediately collected and placed in the dealer's chip rack. This fee may be paid out of the player's chips which are not in play. Second, the player may keep the card they have and play to the end of the hand. Third, the player can pay the house % of their original wager and receive a new card from the dealer, forfeiting their original card and then play until the end of the hand. The fee is not added to the original bet. The original bet is not sacrificed, but the fee is taken from the player's chips and placed in the dealer's chip rack. This fee is paid out of the player's chips which are not in play. This option may only be elected once per round.

Once the players have made their decisions, the dealer turns his card face up.

The dealer would then take the dice cup 80 with the two dice inside 22. For this example, the player's die 25 will be red and the dealer's die 30 will be blue. The dealer shakes the dice 22 in an appropriate manner and throws them on the table 10. The dealer will add the numerical designation of his card with the value shown on the blue house die 30 and the players will add the numerical designation of their cards with the value shown on the red player's die 25. The higher of the two totals between the player and the dealer is the winner. More than one player may win. More than one player can lose.

The house wins all ties in the original bet circle 14. If a player has a final total of 16 and a wager in the "16" circle 16 and a wager in the original bet circle 14, and the dealer also has a final total of 16, the player would lose his original wager, but be paid for the "16" circle wager.

If the player has the higher total they are paid out at even money for their original wager. If the player total is 16 and they had a wager in the "16" circle they are paid out at the rate of 16 to 1.

It is apparent from the above that the present invention accomplishes all of the objectives set forth by providing a wagering game which combines the sum of the value present on the face of a ordinary card drawn from a deck or multiple decks of cards with a number rolled on a six sided dice.

With respect to the above description, it should be realized that the optimum dimensional relationships for the parts of the invention, to include variations in size, materials, shape, form, function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiment of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

I claim:

1. A method of playing a wagering game, said game including at least one deck of cards, said cards having numbered cards having a numerical value equal to the number shown thereon, face cards having a numerical value equal to ten and ace cards having a numerical value of one, a first die and a second die, a house dealer and at least one player, including the steps of, a) said player placing a first wager, b) said dealer dealing a first card to said player, said first card having a first numerical value, c) said dealer dealing a second card to said dealer, said second card having a second numerical value, d) said dealer rolling said first die and said second die, said first die showing a first number and said second die showing a second number, e) said dealer adding the sum of said first numerical value with said first number to reach a players number, f) said dealer adding the sum of said second numerical value with said second number to reach a dealer's number, g) comparing said dealer's number with said player's number whereby if said player's number is greater than said dealer's number, then said player wins said first wager, if said player's number is less than said dealer's number, then said player loses said wager, if said player's number is equal to said dealer's number, then said player loses said wager.

2. A method of playing a wagering game as claimed in claim 1, including the option of said player placing a second wager prior to said dealer dealing said first card, whereby said second wager is paid at 16:1 odds when said player's number is equal to 16.

3. A method of playing a wagering game as claimed in claim 2 wherein said player's second wager is paid at 16:1 odds even if said dealer's number is equal to 16.

4. A method of playing a wagering game as claimed in claim 3 including a player decision step, said player decision step occurring prior to said dealer rolling said first die and said second die, said player decision step selected from the group consisting of, a)said player paying an amount equal to ½ of said first wager to said dealer and resigning, b)said player keeping said first card and continue playing, and c) said player surrendering ½ of said first wager, receiving a new card, and continue playing.

5. A method of playing a wagering game as claimed in claim 4 wherein said second card is dealt face down, so that said player and said dealer may not ascertain said second numerical value.

6. A method of playing a wagering game as claimed in claim 5 wherein said second card is overturned and said second numerical value ascertained immediately after said player decision step.

7. A method of playing a wagering game as claimed in claim 6 wherein said first wager is paid at even money.

8. A method of playing a wagering game as claimed in claim 7 wherein said second wager is lost if said first numerical value is not equal to 10.

9. A method of playing a wagering game as claimed in claim 8 wherein said at least one player includes a plurality of players.

* * * * *